United States Patent [19]

Duerr et al.

[11] Patent Number: 4,503,489

[45] Date of Patent: Mar. 5, 1985

[54] ABOVE GROUND LOW VOLTAGE UNDERWATER LIGHT

[76] Inventors: Peter C. Duerr, 4757 W. 175th Pl., Country Club Hills, Ill. 60477; Claude De Facci, 22536 Lake Shore Dr., Richton Park, Ill. 60471

[21] Appl. No.: 596,658

[22] Filed: Apr. 4, 1984

[51] Int. Cl.[3] ..... F21V 33/00

[52] U.S. Cl. ..... 362/101; 362/145; 362/147; 362/267; 362/306; 362/364; 362/365; 362/368

[58] Field of Search ..... 362/101, 145, 147, 267, 362/306, 364, 365, 368

[56] References Cited

U.S. PATENT DOCUMENTS 3,962,675 6/1976 Rowley et al. ..... 362/101

4,460,944 7/1984 Gordbegli et al. ..... 362/101

*Primary Examiner*—Stephen J. Lechert, Jr.

*Attorney, Agent, or Firm*—Sixbey, Friedman & Leedom

[57] ABSTRACT

An underwater light (12) for above ground pools (10) includes a housing (28) sealed to the outer surface of the pool wall (24). An opening in the pool wall and liner (16) communicates with an opening in the front wall (28) of the housing, and a light transmitting cover assembly (70) is sealed to the pool liner (16) to cover this opening. The rear wall (34) of the housing is removable to provide access to a light unit mounting assembly including a base bracket (38) secured around a light (58) and biases the cushioning gasket into engagement with a pad mount (56). This facilitates removal and replacement as well as adjustment of the light (58) without interrupting pool operation.

20 Claims, 5 Drawing Figures

ABOVE GROUND LOW VOLTAGE UNDERWATER LIGHT

DESCRIPTION

1. Technical Field

The present invention relates, in general, to above ground swimming pools, and more particularly, to illumination of above ground swimming pools.

2. Background Art

Recently, people have become more aware of a need for exercise programs, and jogging, tennis, bicycling and the like have become popular. Swimming is one of the safest and most efficient forms of exercise and has, like the other sports, become extremely popular. In addition to providing an excellent form of exercise, swimming can be a social sport, and many social activities can be conducted around a swimming pool. Accordingly, privately owned swimming pools have increased in popularity and particularly apartment houses, condominiums, housing associations and the like are normally provided with swimming pools.

Swiming pools associated with single family dwellings have become prevalent in recent years, although a landscaped pool area in combination with a pool installed below the ground level is quite expensive to construct. Much of the growth in the single family pool market can be attributed to the development of above ground pools which are less expensive to install and maintain.

With the increasing popularity of swimming pools in general and above ground pools in particular, it is becoming more desirable to provide above ground pools with all of the features previously found only in permanently installed, below ground level pools. In addition to many general considerations such as decking and landscaping, pool illumination has become an important specific consideration. Illumination of a pool is important to the swimmers and divers alike, but also has important effects on general beauty, security, safety and usability of the pool. Illumination can create many different aesthetic effects, and can be used to provide a natural pool appearance, to account for uneven pool sideways or even to permit a pool to be lighted by changing color patterns for even more variety.

Most swimming pool lighting assemblies presently available have been designed for in ground pools where special, sealed light receiving chambers are formed in the pool wall when the pool is constructed. These lighting assemblies are generally not adapted for use in above ground pools where the pool wall is formed by a thin sheet metal support structure for a thin plastic pool liner.

Pool lights have been developed which are not mounted in the pool wall, thus rendering such lights suitable for use in above ground pool installations. For example, lights which are supported from above and which hang down into a pool are disclosed in U.S. Pat. No. 3,456,103 issued to J. N. Bond and U.S. Pat. No. 3,864,562 issued to D. K. Hawkins. While effective in providing light, these devices may not adequately meet the requirements of aesthetic appeal, safety and security for modern above ground pools. Lights such as these which project outwardly from the pool wall into the pool may create a hazard, as a swimmer or diver may accidentally bump into such a light causing possible damage to the light and injury to the swimmer or diver. The likelihood of injury to swimmers increases if a light projecting into the pool becomes broken and is not immediately removed or repaired. Furthermore, lights which are offset from a pool wall into the pool may create undesirable shadows and uneven illumination.

DISCLOSURE OF THE-INVENTION

It is a primary object of the present invention to provide a novel underwater light for an above ground pool which is easily, safely and securely installed on a sidewall of the pool and which has no parts which project into the pool.

Another object of the present invention is to provide a novel underwater light for an above ground pool wherein the housing for the light is mounted on an external pool wall and is located outside the pool. This housing includes a removable rear wall and a light mounting assembly which permits safe replacement of the light without the necessity to drain the pool or interrupt pool use.

A further object of the present invention is to provide a novel underwater light for an above ground pool wherein the light beam directed into the pool may be angularly adjusted to achieve desired lighting without interferring with pool operation. A novel light mounting assembly is provided which permits the light to be easily moved to accomplish angular adjustment but which incorporates a spring action to securely retain the light in any adjusted position.

Yet another object of the present invention is to provide a novel underwater light for an above ground pool which includes a unique light mounting assembly to permit quick and easy snap in installation and adjustment of a light bulb with the electrical connection therefor.

A still further object of the present invention is to provide a novel and improved underwater light for an above ground pool wherein the housing for the light is mounted on the outside of a pool liner and support wall therefor while the light transmitting cover assembly for the housing is mounted inside the pool liner. The housing is sealed to the outer surface of the support wall while the light transmitting cover assembly is sealed to the pool liner.

These and other objects are accomplished by providing an underwater light for an above ground pool which includes a housing sealed to the outside of the pool wall. The housing has an open front and a hole corresponding to the open front of the housing is cut through the pool wall and the pool liner. A light transmitting cover assembly for the housing is sealed inside the pool to the pool liner and lies substantially flush with the pool liner so that there is no projection extending into the pool. A novel light mounting assembly is provided in the housing which includes a "U" shaped bottom mount having two spaced, spring metal legs with a notch cut in the upper edge of each leg. A doughnut shaped cushioning gasket which extends around a light bulb assembly is received in the notch of each leg, and the legs spring outwardly to permit the cushioning gasket to slip under the pad of an upper mount. The bottom mount biases the cushioning gasket upwardly to tightly retain the light bulb assembly in position, but the angle of the beam from the light bulb may be easily altered by sliding the cushioning gasket forwardly or rearwardly under the pad of the upper mount. A removable rear wall on the housing combines with the light mounting assembly to permit either replacement or adjustment of the lightbulb from outside the pool without requiring drainage of the pool or the interruption of pool operation.

BEST MODE-FOR CARRYING OUT THE INVENTION

Figure 1:
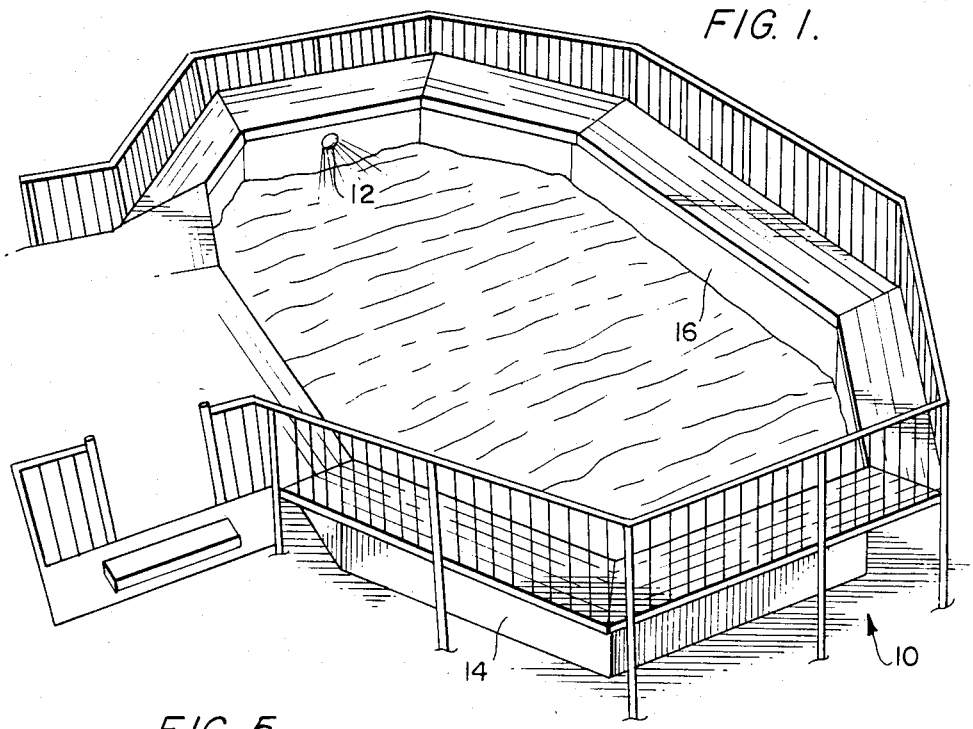
FIG. 1 is a perspective view of an above ground pool which includes an underwater light assembly of the present invention.
Figure 5:
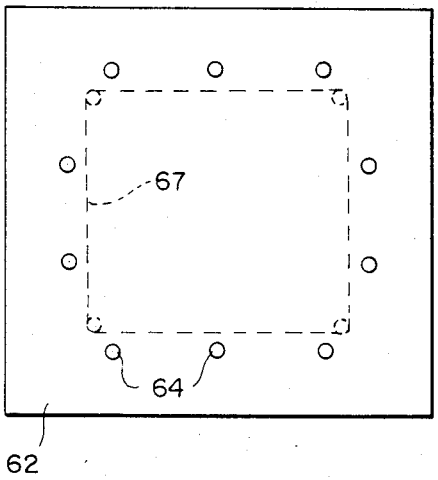
FIG. 5 is a plan view of a template used in mounting the underwater light unit of FIG. 3.

Referring now to FIG. 1, an above ground pool indicated generally at 10 is shown with the water level below the level of pool light 12 which is installed in the wall of the pool. For installation of the pool light 12 of the present invention, the level of the water in the pool must be at least as low as the level illustrated in FIG. 1, and ideally, the pool would be completely drained. As is typical with above ground pools, the pool wall is formed by an outer support wall 14 of metal, wood, or similar support material which supports an inner pool liner 16.

Figure 2:
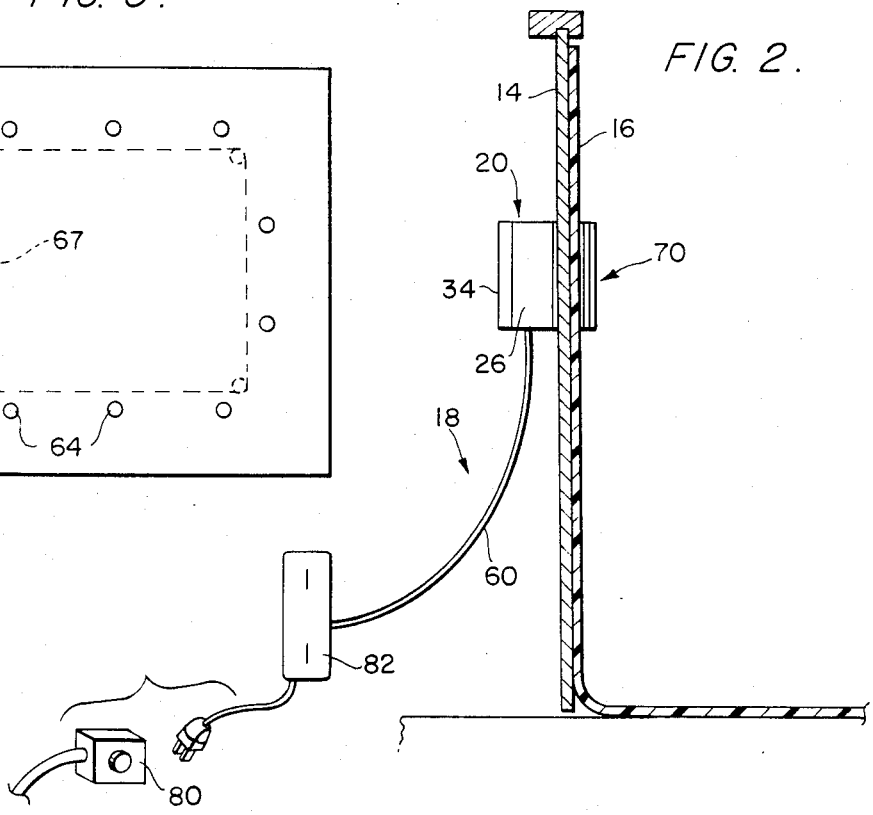
FIG. 2 is a partially sectioned view showing the underwater light assembly of the present invention.
Figure 3:
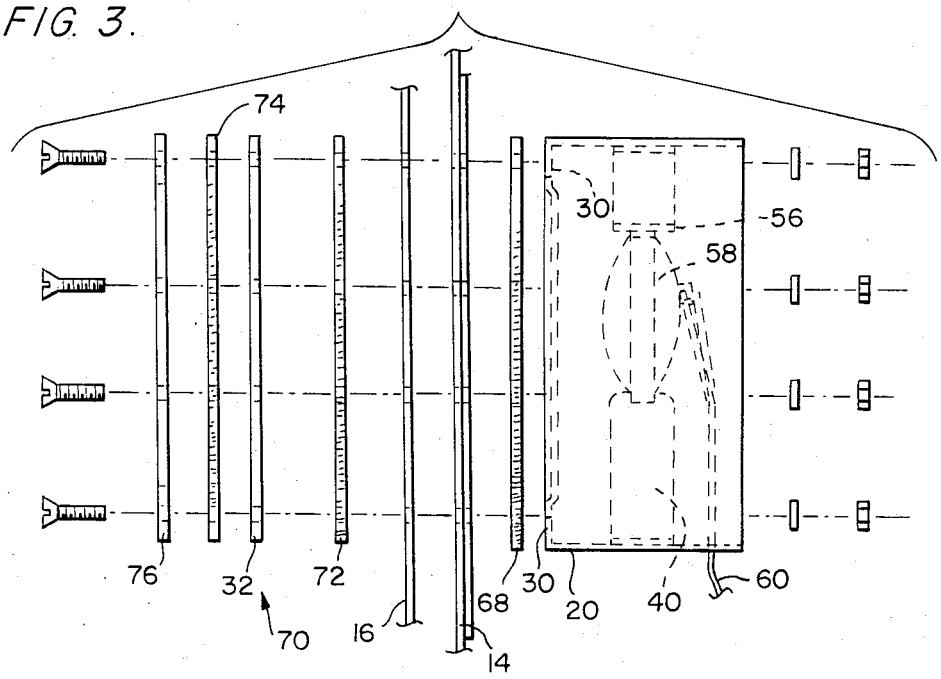
FIG. 3 is an exploded view in side elevation of an underwater light unit for the underwater light assembly of the present invention.
Figure 4:
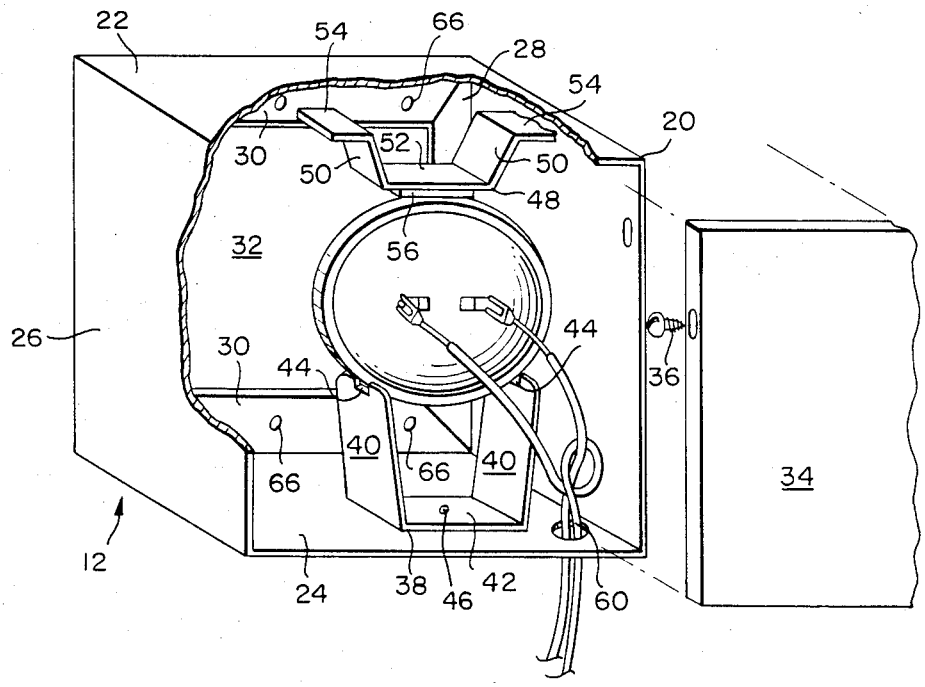
FIG. 4 is a partially sectioned perspective view of the housing and light mounting assembly for the underwater light unit of FIG. 3.

FIGS. 2, 3 and 4 show the underwater light assembly 18 of the present invention wherein the pool light 12 includes a housing 20 having a top wall 22, a bottom wall 24 and sidewalls 26 extending between the top and bottom walls. A front wall 28 of the housing is formed by a framing section 30 which extends inwardly from the top, bottom and side walls and which mounts a light transmitting plate 32 of glass, plastic or other light transmitting material. The light transmitting plate will be sealed to the liner 16 so that water cannot enter the housing around the plate.

The housing 20 includes a removable rear wall 34 which may be secured to the housing in any suitable manner, such as by fasteners 36. Once the housing is secured in place on the pool wall, the rear wall 34 may be removed to gain access to the interior of the housing so that pool light maintenance or adjustment can be accomplished without draining the pool.

A special bulb mounting assembly is provided within the housing 20 so that a bulb may be quickly and easily mounted in the housing or removed for replacement. This mounting assembly also permits the bulb to be tilted to change the angle of the beam into the pool. Basically, the bulb mounting assembly includes a "U" shaped base bracket formed of spring metal or similar material and having a pair of spaced legs 40 which are joined by a web 42. This web is secured to the bottom wall 24 of the housing 20 so that the legs 40 project upwardly into the housing. The free end of each leg is formed with a slot or notch 44 extending inwardly from the edge thereof, and the notches in the two legs are substantially aligned to receive the light bulb. The base bracket is secured by a single vertical mounting point 46, allowing the bracket to swivel horizontally, further allowing the light bulb's beam to be directed in a variety of positions.

The remainder of the bulb mounting assembly is formed by a generally hat shaped upper bracket 48 having a pair of spaced legs 50 joined by a web 52. Wing sections 54 extend laterally and outwardly from the free ends of the legs 50 and are secured to the top wall 22 of the housing 20. A pad 56 of resilient material is secured to the lowermost surface of the web 52 to engage the light bulb.

To install the lightbulb within the housing 20, the lightbulb is inserted into the notches 44. The lightbulb is pressed downwardly causing the legs 40 to flex outwardly until the outer edge of the bulb can be inserted under the pad 56. The spring action of the legs 40 holds the lightbulb tightly against the pad 56 to positively retain the lightbulb in position. The lightbulb is oriented to direct a beam of light out through the light transmitting plate 32, and the angular orientation of the beam may be simply adjusted by moving the upper portion of the bulb under the pad 56 toward or away from the plate 32. This causes the lightbulb to pivot about a horizontal axis, and the spring action of the legs 40 will operate to tightly retain the lightbulb against the pad 56 in any adjusted position.

The lightbulb 58 is not shown in detail, and may constitute suitable known bulb and socket assemblies. Power is provided to the lightbulb from outside the housing by wires 60.

To install the housing 20 on the pool 10, an installation template 62 is secured to the outer wall 14 of the pool in a desired location for the pool light 12. This template defines bolt locations which align with bolt receiving holes 66 in the framing section 30. Also, when the wall 14 and liner 16 are cut out along dotted lines 67 in the template, an opening is formed in the pool wall and liner in a proper position for installation of the pool light 12 once holes are drilled in the wall and liner at the locations 64.

Referring to FIG. 3, the housing 20 and a gasket 68 are positioned against the outer pool wall 14 over the openings previously formed therein by using the template 62. The gasket 68 is formed of rubber or some similar material which will provide a water impervious seal between the framing section 30 and the pool wall 14. The gasket is provided with bolt receiving holes which align with similar holes 66 in the framing section 30, and this gasket frames both the opening in the pool wall and the open portion of the front wall 28 which is aligned with such opening.

On the inside of the pool, opposite the housing 20, a cover assembly 70 is sealed against the pool liner 16. This cover assembly includes a first gasket 72, the light transmitting plate 32, a second gasket 74 and a face plate 76. All of these elements include bolt holes which align with those in the framing section 30 so that the cover assembly can be secured to the liner 16 by bolts 78 which extend through the cover assembly, the liner, the outer wall, the gasket 68 and the holes 66 in the framing section 30. The first and second gaskets 72 and 74, like the gasket 68, are made of rubber or other sealing material to form a water impervious seal. These gaskets, like the face plate 76 frame the light transmitting plate 32 so that light from the bulb 58 passes out the opening in the front of the housing 20 defined by the framing section 30, through the openings in the pool wall and liner and out through the light transmitting plate into the pool 10.

As will be noted from FIG. 2, the underwater light assembly 18 is powered from a conventional 115 volt, 60 cycle power source 80. Power from this power source is directed to a timer transformer 82 where it is converted to a 12 volt A.C., 108 watt current which is transmitted over wire 60 to the lightbulb 58. The timer portion of the timer/transformer constitutes a 24 hour timer which can be preset to control the period of time during which the pool light is activated.

Industrial Applicability

The pool light 12 of the present invention is mounted upon the wall of an above ground pool so that the entire light housing 20 is located outside the pool wall 14 for both safety and convenience. The cover assembly 70 lies substantially flush with the pool liner, and there are no protrusions within the pool to contact and possibly injure a swimmer.

The lightbulb 58 may be safely and easily replaced from outside the pool by merely removing the rear wall 34 of the housing 20. This may be accomplished without draining water from the pool or disturbing swimming activities in any way, and there is no danger to the person performing this function. In the same manner, the angle of the light beam may be easily adjusted to accomodate all individual lighting tastes and to provide enhanced lighting to accomodate uneven pool walls. If colored lighting is desired, color lenses may be inserted against the inner surface of the framing section 32, and clips can be provided on the framing section to receive and hold such lenses in place.

We claim:

1. An underwater light and above ground swimming pool combination having a pool wall extending above ground level and having an opening therein which extends therethrough between an outer and inner surface, comprising a housing having a front wall with an opening therein which is not larger than the opening in said pool wall, said housing being mountable in cantilever fashion on the outer surface of said pool wall with the front wall thereof adjacent to said outer surface and the opening in said front wall communicating with the opening in said pool wall, mounting means within said housing for mounting a light generating light assembly means to transmit light through said openings in said front wall and pool wall, a light transmitting cover assembly mounted within said pool on said inner surface for sealingly closing said opening of the front wall of the housing with an edge of the pool wall defining said opening in the pool wall disposed therebetween, and access means for providing access to the light assembly within said housing without demounting of said housing or cover assembly.

2. The underwater light assembly of claim 1, which includes first sealing means for sealing said light transmitting cover assembly to said inner surface and second sealing means extending around the openings in said pool and housing front walls to seal said housing to said outer surface.

3. The underwater light assembly of claim 2, wherein said pool wall includes an outer support wall for providing said outer surface and a pool liner inside said outer support wall for providing said inner surface, said underwater light assembly including fastening means for extending from said light transmitting cover to said housing through said liner and support wall for drawing said housing and light transmitting cover assembly together.

4. The underwater light assembly of claim 1, wherein said mounting means includes a spring seat means mounted on said housing to receive a light unit, a pad mount means spaced opposite said spring seat means and mounted on said housing to engage a light unit, said spring seat means operating to bias said light unit toward said pad mount means to tightly hold the light unit therebetween.

5. The underwater light assembly of claim 4, wherein said spring seat means retains said light unit while permitting movement of said light unit relative to said pad mount means.

6. The underwater light assembly of claim 5, wherein said mounting means includes a light unit being received by said spring seat means and operative to engage said pad mount means to retain said light unit within the housing.

7. The underwater light assembly of claim 6, wherein said light unit is connected to electrical power supply means operative to supply power thereto, said electrical power supply means including a step down transformer.

8. The underwater light assembly of claim 7, wherein said electrical power supply means includes timer means to control the time during which power is supplied to said light unit.

9. An underwater light assembly for use in illuminating above ground swimming pools comprising a housing having a front wall through which light can pass, a bottom wall, and sidewalls and a back wall extending between said top and bottom walls, spring seat means secured within said housing to said bottom wall to receive a light unit, a pad mount means mounted within said housing on said top wall opposite and in space relation to said spring seat means to engage a light unit, said spring seat means operating to bias a light unit, received therein against said pad mount means, and access means on said housing to provide access to said spring seat and pad mount means.

10. The underwater light assembly of claim 9, wherein said spring seat means includes a substantially "U" shaped unit having two spaced legs of spring material projecting upwardly in spaced relationship from a web section extending between said legs, said web section being secured to the bottom wall of said housing and each said leg terminating in an upper terminal edge, a notch formed in the upper terminal edge of each said leg, the notch in each leg being substantially aligned with the notch in the remaining leg.

11. The underwater light assembly of claim 10, wherein said lightbulb being received in the notch provided in each such leg and engaging said pad mount means to hold said light unit in place.

12. The underwater light assembly of claim 11, wherein said legs may be sprung outwardly to permit movement of said lightbulb relative to said pad mount means toward and away from said front wall while said lightbulb is retained in the notch in each such leg.

13. The underwater light assembly of claim 12, wherein said access means operates to permit attachment and removal of said back wall from said housing.

14. An underwater light assembly for use in illuminating above ground swimming pools having a pool wall extending above ground level which includes an inner and outer surface, comprising a housing means defining a compartment for receiving a light unit, said housing means having a pool engaging surface constructed in a manner to enable it to be positioned, in cantilever fashion, adjacent the outer surface of said pool wall, said pool engaging surface extending peripherally around a light transmitting opening formed in said housing means and opening into said compartment and access means spaced relative to said pool engaging surface so as to be located exteriorly of said pool wall when, in use, said pool engaging surface is positioned adjacent the outer surface of the pool, said access means including an access opening formed in said housing means and closure means operative to selectively open or close said access opening, mounting means secured to said housing within said compartment and operative to mount a light unit to direct light through said light transmitting opening, first gasket means having an opening therein, said first gasket means being adapted to extend between said pool engaging surface and the outer surface of the pool wall and to extend around said light transmitting opening to provide a watertight seal between said pool engaging surface and the outer surface of said pool wall, a light transmitting plate means having an inner surface and an outer surface and operative to transmit light passing through said light transmitting opening, the inner surface of said light transmitting plate means being adapted to be positioned adjacent the inner surface of said pool wall, second gasket means having an opening therein and being adapted to extend between the inner surface of said light transmitting plate means and the inner surface of said pool wall and to extend around the light transmitting opening in said housing means, said second gasket means operatig to provide a watertight seal between said inner surface of the pool wall and the inner surface of said light transmitting plate means, a face plate means having an opening therein, said face plate means extending around the light transmitting opening in said housing means, and a third gasket means having an opening therein and being adapted to extend between the face plate means and the outer surface of said light transmitting plate means and to extend around the light transmitting opening in said housing means, said third gasket means operating to provide a watertight seal between said faceplate means and said light transmitting plate means, and fastening means for sequentially securing said face plate means, third gasket means, light transmitting plate means and second gasket means to the inner surface of said pool wall and said first gasket means and housing means to the outer surface of the pool wall in an operative condition thereof, said access opening being openable by way of said closure means without removal of said securing means from its operative condition.

15. The underwater light assembly of claim 14 wherein said housing means includes a top wall, a bottom wall and sidewalls and a backwall extending between said top and bottom walls, said backwall forming the closure means for said access means and being removable from said housing means.

16. The underwater light assembly of claim 14 wherein spaced holes are formed peripherally to extend through said pool engaging surface, said light transmitting plate means, said third gasket means and said face plate means, said spaced holes adapted to align when said pool engaging surface, first gasket means, second gasket means, light transmitting plate means, third gasket means and face plate means are positioned on said pool wall, said fastening means being adapted to extend through said spaced holes to secure and seal said pool engaging surface, first gasket means, second gasket means, light transmitting plate means, third gasket means and face plate means together and to said pool wall, said second gasket means, light transmitting plate means, third gasket means and face plate means being formed by substantially flat units which when assembled, form a unit which lies flat against said pool wall inner surface with a minimal projection therefrom.

17. The underwater light assembly of claim 16 which includes template means for engagement with the outer surface of said pool wall, said template means including indicia corresponding to the position of said spaced holes and said light transmitting opening to locate and permit corresponding holes and a pool wall opening to be formed in said pool wall.

18. The underwater light assembly of claim 17 wherein said housing means includes a top wall, a bottom wall and sidewalls and a backwall extending between said top and bottom walls, said backwall forming the closure means for said access means and operating to provide access to said compartment, said mounting means being secured to at least the bottom wall of said housing within said compartment, and a light unit mounted in said mounting means.

19. The underwater light assembly of claim 18 which includes power supply means connected to provide power to said light unit, said power supply means including a power cord extending through an opening in said housing to said light unit, a step down transformer connected to supply power to said power cord, and timer means connected to control the time period during which power is provided to said light unit.

20. The underwater light assembly of claim 18 wherein said mounting means is operative to permit adjustment of the position of said light unit relative to said light transmitting opening to permit altering the direction of a light beam from said light unit.

* * * * *